US010611606B2

(12) United States Patent
Rothmann et al.

(10) Patent No.: US 10,611,606 B2
(45) Date of Patent: Apr. 7, 2020

(54) FILL DEGREE CONTROL FOR A BULK MATERIAL GRIPPER OF A CRANE

(71) Applicant: Konecranes Global Corporation, Hyvinkää (FI)

(72) Inventors: Jürgen Rothmann, Langenfeld (DE); Arno van de Loo, Monhein am Rhein (DE)

(73) Assignee: Konecranes Global Corporation, Hyvinkää (FI)

( * ) Notice: Subject to any disclaimer, the term of this patent is extended or adjusted under 35 U.S.C. 154(b) by 40 days.

(21) Appl. No.: 15/325,919

(22) PCT Filed: Jul. 17, 2015

(86) PCT No.: PCT/EP2015/066400
§ 371 (c)(1),
(2) Date: Jan. 12, 2017

(87) PCT Pub. No.: WO2016/009040
PCT Pub. Date: Jan. 21, 2016

(65) Prior Publication Data

US 2017/0166421 A1 Jun. 15, 2017

(30) Foreign Application Priority Data

Jul. 17, 2014 (DE) ..... 10 2014 110 060

(51) Int. Cl.
*B66C 3/12* (2006.01)
*B66C 13/16* (2006.01)
(Continued)

(52) U.S. Cl.
CPC ..... *B66C 3/125* (2013.01); *B66C 13/16* (2013.01); *B66C 13/18* (2013.01); *B66C 13/22* (2013.01); *B66C 13/32* (2013.01)

(58) Field of Classification Search
CPC ..... B66C 3/125; B66C 13/32; B66C 13/16; B66C 13/18; B66C 13/22
See application file for complete search history.

(56) References Cited

U.S. PATENT DOCUMENTS 3,776,513 A * 12/1973 Mosley ..... B66C 3/125 254/356
6,256,553 B1 * 7/2001 Erikkila ..... B66C 13/063 212/284
(Continued)

FOREIGN PATENT DOCUMENTS

DE 244962 A1 4/1987
DE 288138 A5 3/1991
(Continued)

OTHER PUBLICATIONS

Translation of JPS57151735 obtained via ESPACENET on Jul. 24, 2018. (Year: 1982).*
(Continued)

*Primary Examiner* — Jeffrey C Boomer
(74) *Attorney, Agent, or Firm* — Gardner, Linn, Burkhart & Ondersma LLP

(57) ABSTRACT

A method for filling a gripper for bulk material, with the gripper being suspended on holding cables, raised and lowered by a crane via a controller, and acting on the bulk material with the gripper weight during the closing and filling process. By reducing the effect of the weight of the gripper on the bulk material, a fill degree of the gripper is influenced via the controller in that a tensile force acting on the holding cables is influenced in order to optimally fill the gripper. A tensile force TARGET value is determined for the holding cables via the controller and is output to a tensile force controller as an input variable. An electric motor for lifting and lowering the gripper is controlled by the tensile force controller, and an ascertained tensile force ACTUAL
(Continued)

value of the holding cables is supplied to the tensile force controller as an input variable.

19 Claims, 4 Drawing Sheets

(51) Int. Cl.

| | |
|---|---|
| ***B66C 13/18*** | (2006.01) |
| ***B66C 13/22*** | (2006.01) |
| ***B66C 13/32*** | (2006.01) |

(56) References Cited

U.S. PATENT DOCUMENTS

| | | | | |
|---|---|---|---|---|
| 7,119,295 | B2 | 10/2006 | Röhr et al. | |
| 7,416,169 | B2 * | 8/2008 | Noeske | B66C 13/18 212/274 |
| 2010/0044332 | A1 | 2/2010 | Cameron | |
| 2011/0062104 | A1 | 3/2011 | Schneider et al. | |
| 2011/0313626 | A1 | 12/2011 | Bowen et al. | |

FOREIGN PATENT DOCUMENTS

| | | | |
|---|---|---|---|
| DE | 4034006 | A1 | 4/1992 |
| DE | 19955750 | B4 | 5/2004 |
| DE | 102008045330 | A1 | 4/2010 |
| DE | 102009011604 | A1 | 9/2010 |
| EP | 0458994 | A1 | 12/1991 |
| EP | 2226287 | A1 | 9/2010 |
| EP | 2298687 | A2 | 3/2011 |
| EP | 2613207 | A2 | 7/2013 |
| JP | S57151735 | A | 9/1982 |
| JP | H01247393 | A | 10/1989 |
| JP | H01278621 | A | 11/1989 |
| JP | 2010070338 | A * | 4/2010 |

OTHER PUBLICATIONS

Preliminary Report on Patentability of the International Searching Authority in English from corresponding Patent Cooperation Treaty (PCT) Application No. PCT/EP2015/066400, completed Nov. 24, 2016.

International Search Report of the International Searching Authority from corresponding Patent Cooperation Treaty (PCT) Application No. PCT/EP2015/066400, dated Oct. 13, 2015.

Written Opinion of the International Searching Authority from corresponding Patent Coopeartion Treaty (PCT) Application No. PCT/EP2015/066400, indicated completed on Jan. 12, 2016.

International Preliminary Examination Report from corresponding Patent Cooperation Treaty (PCT) Application No. PCT/EP2015/066400, dated Jun. 27, 2016.

* cited by examiner

FILL DEGREE CONTROL FOR A BULK MATERIAL GRIPPER OF A CRANE

The present application claims the priority benefits of International Patent Application No. PCT/EP2015/066400, filed Jul. 17, 2015, and claims benefit of DE 102014110060.3, filed on Jul. 17, 2014.

BACKGROUND OF THE INVENTION

The invention relates to a method for filling a gripper for bulk material.

It is generally known that grippers are used for handling bulk materials, such as e.g. ore, coal, grain, gravel or sand. These grippers which are also defined as a clamshell grab or grapple have a size, shape and number of shells optimized in each case with regard to the bulk material to be handled. This ensures that the grippers can penetrate into the bulk material in an effective manner, can be filled with the bulk material and the bulk material can be emptied therefrom in an effective manner. Typically, the grippers are lowered in an open position onto the bulk material, sink into the bulk material by reason of their own weight and during a closing movement the grippers pick up the bulk material and are filled therewith. The grippers are closed hydraulically or by means of cable drives.

A crane comprising a gripper for bulk material is known from German patent DE 199 55 750 B4. The gripper is designed as a so-called four-cable gripper. Accordingly, two holding cables and two closing cables are provided which can be moved independently of one another, in order to open, close, lift and lower the gripper. The holding and closing cables are driven separately by two cable drums. In order to open the gripper, the closing cables are relieved and the gripper hangs only on the holding cables. The holding cables act upon a lever mechanism of the gripper and serve, in conjunction with the weight of the gripper, to open the gripper. For a filling procedure, the opened gripper having a slack closing cable is placed onto the bulk material by means of the holding cables. In order to allow the gripper to sink into the bulk material under the effect of its own weight, the holding cable is then slackened. By tightening the closing cables, the gripper is then closed, wherein it is filled and subsequently raised by the closing cables after the gripper is closed. In this case, the holding cables must then be tautened in parallel, in order to avoid slack cable. In the region where the gripper is raised, the forces in the holding and closing cables are then adjusted with respect to one another via corresponding controllers, so that the subsequent lifting is effected jointly with the holding and closing cables.

Typically, data relating to the bulk weight density, gripper volume and the weight of the gripper are not input into a crane controller of the crane. Under the rough conditions of use of the gripper, a fill level of the gripper is taken into consideration only indirectly using empirical values.

A method for preventing overloading of a gripper suspended on holding cables and closing cables is already known from DD 288 138 A5. In this case, during the closing procedure a tensile force acting in the closing cables and in the holding cables is measured and its difference is compared with a target value for the tensile force acting in the closing cables. If the difference exceeds a specified value for the target closing force, the holding motor is activated, whereby the still not completely closed gripper is raised and continues to be closed. In this manner, the effect of the weight of the gripper, by means of which the gripper acts upon the bulk material during closing and filling, is reduced and a fill degree of the gripper is influenced.

Furthermore, a tension control for the gripper cables of a bulk material handling apparatus comprising holding cables and closing cables is known from EP 0 458 994 A1. In order to avoid a jerking movement which is caused by slack holding cables when the gripper is being closed, the holding tension is controlled accordingly. However, the holding tension is controlled in such a manner that during the closing procedure no reduced effect of the weight of the gripper on the bulk material is achieved because the gripper is only raised if it is completely closed. Therefore, the tension control does not influence the fill degree of the gripper.

DD 244 962 A1 describes a method for controlling pick-up of goods for an automated gripper operation. In this case, during the closing procedure of the gripper a gripper opening angle and a closing time of the gripper lowered onto the bulk material are monitored. If, during the closing procedure, the gripper cannot be closed to a specified extent within a specified time, the closing procedure is interrupted and a lifting gear is activated, in order to raise the gripper from the bulk material. Then, the closing procedure is restarted and a check is carried out to establish whether it can be performed as specified.

A method for filling a gripper suspended on holding cables is known from European patent document EP 2 226 287 B1, the gripper filling volume of said gripper being influenced in that a holding torque of a holding mechanism for the gripper is controlled in such a manner that during the closing procedure a gripping curve of the gripper is raised.

SUMMARY OF THE INVENTION

The object of the invention is to provide a method for optimally filling a gripper for bulk material which is raised and lowered by a crane via a controller and which during closing and filling acts with its own weight upon the bulk material.

Advantageous embodiments of the invention and a use of the invention are described herein.

In accordance with an embodiment of the invention, in the case of a method for filling a gripper for bulk material, said gripper being suspended on holding cables, raised and lowered by a crane via a controller and acting on the bulk material with its own weight during the closing and filling procedure, wherein by reducing the effect of the weight of the gripper on the bulk material, a fill degree of the gripper is influenced via the controller in that a tensile force acting on the holding cables is influenced, an optimized fill degree of the gripper is achieved by virtue of the fact that a tensile force TARGET value is determined for the holding cables via the controller, the tensile force TARGET value is output to a tensile force controller as an input variable, an electric motor for lifting and lowering the gripper is controlled by the tensile force controller and an ascertained tensile force ACTUAL value of the holding cables is supplied to the tensile force controller as an input variable. In this manner, overload cut-offs are also avoided.

This invention advantageously ensures that the fill degree of a bulk material gripper can be controlled. This means that, during operation of a crane comprising a bulk material gripper, an excessive number of overload cut-offs are avoided and therefore the handling performance of the crane is increased. Such overload cut-offs occur if during gripper operation the gripper penetrates very deeply into the bulk material to be raised and therefore too much bulk material is picked up by the gripper. This alone can already result in an overload cut-off of the crane if the gripper picks up more bulk material than the crane can lift. In combination with a large working radius of the crane, this effect is increased because the permitted working load of the crane decreases and therefore an overload is achieved even more readily and, in turn, the crane is subjected to an overload cut-off. Should the gripper be rather undersized in relation to the crane, such overload cut-offs of the crane can only occur on the crane if the crane has a large working radius. Since the handling performance of the crane is always optimized from an economic point of view, a crane is preferably operated in the range of its permitted working load and therefore with a gripper which can achieve an optimum fill degree over the entire working radius range, i.e. which is preferably slightly oversized in relation to the working load of the crane or is optimally dimensioned in relation to small working radiuses. This is associated with the fact that a deployed gripper tends rather to become overfilled in relation to the crane and therefore can affect the method in accordance with the invention which is directed at purposefully reducing the effect of the weight of the gripper. It is also permitted to use excessively large grippers in relation to the working load of the crane and the bulk material density of the bulk material to be conveyed, since these grippers are only partially filled by the invention. The influence of the tensile force, which acts in the holding cables and is exerted in order to reduce the effect of the weight of the gripper on the bulk material in particular during the closing procedure of the gripper, occurs in this case to such an extent that the gripper penetrates less deeply into the bulk material than would normally do alone on account of its own weight.

In practice, the controller in accordance with the invention can be used to reduce the number of overload cut-offs by 90% whilst at the same time handling performance is increased.

A working load in terms of the invention is made up of the weight of the gripper, bulk material picked up and, in the case of a cable gripper, the weight of the cable between the point of the jib and the gripper.

In an advantageous manner, provision is also made that a time of a change in the tensile force TARGET value and an increment of a change in the tensile force TARGET value is supplied in the controller via a tendency module with reference to progressions of ascertained working loads. By incorporating the tendency module, stored empirical values—such as e.g. handling a comparable bulk material using the current gripper—and achieved fill degrees recorded during the handling operation of the crane render it possible for an optimum fill degree to be achieved more rapidly and overloads to be avoided more reliably. In this case, the changes in the tensile force TARGET value during the closing procedure are dynamically adapted, so that an optimum utilization of the working load curve is provided in the entire working radius range and overloads are avoided or at least minimized.

In one advantageous embodiment, provision is made that the tensile force TARGET value is increased via the tendency module if the frequency of overload cut-offs exceeds a preselected value related to load cycles and/or if the frequency with which the maximum permissible working load is exceeded exceeds a value preselected in relation to the maximum permissible working load for a given working radius.

In one advantageous embodiment, provision is made that the tensile force TARGET value is decreased via the tendency module if the frequency of overload cut-offs is less than a preselected value related to the load cycles and/or if the frequency with which the maximum permissible working load is exceeded is less than a value preselected in relation to the maximum permissible working load for a given working radius.

In a particularly advantageous embodiment, provision is made that during the closing and filling procedure the gripper is influenced with the tensile force ACTUAL value, which is directed in a direction of lifting, via the crane by means of the controller.

In order to avoid any overloads of the crane, provision is made that in the controller the fill degree of the gripper is determined from a working load, which is ascertained directly after the filled gripper is raised, and the known weight of the gripper.

The fill degree is determined more precisely by virtue of the fact that a length of a free cable starting from the gripper and in the direction of lifting is supplied as an input variable to the controller via a cable length module, and in the controller a weight of the free cable is also assigned to the weight of the gripper during the calculation of the fill degree of the gripper.

Typically, cranes for handling bulk material have a pivotable or tiltable jib, so that the working radius of the crane changes during handling and corresponding pivoting or tilting of the jib. In order to take this into consideration, provision is advantageously made that in dependence upon a working radius of the gripper a maximum permissible working load is supplied to the controller via a working load curve module as an input variable for the crane. Therefore, the controller has the maximum permissible working load at its disposal, in order to establish overload situations and to determine the fill degree of the gripper.

It is also advantageous that a tensile force TARGET value as a start variable is manually input into the controller via a start value module as an input variable. In particular, after a gripper has been replaced or at the beginning of a new handling job involving a bulk material with a different density, the start variable can be input on the basis of empirical values. As a result, the controller can achieve an optimum fill degree of the gripper more rapidly.

In a particular embodiment, in the controller the tensile force TARGET value is iteratively decreased or increased using the input variables from the working load curve module, the cable length module and the ascertained working load, until the fill degree of the gripper is in the region of 100%.

The use of the previously described method in accordance with the invention is particularly advantageous for a crane comprising a gripper which is raised, lowered, opened and closed by means of holding cables and closing cables.

The controller addressed by the method in accordance with the invention is also considered to be independently inventive and its use is associated with the advantages previously described in relation to the method.

The invention will be explained in greater detail hereinafter with reference to an exemplified embodiment illustrated in the drawings.

DESCRIPTION OF THE PREFERRED EMBODIMENTS

Figure 1:
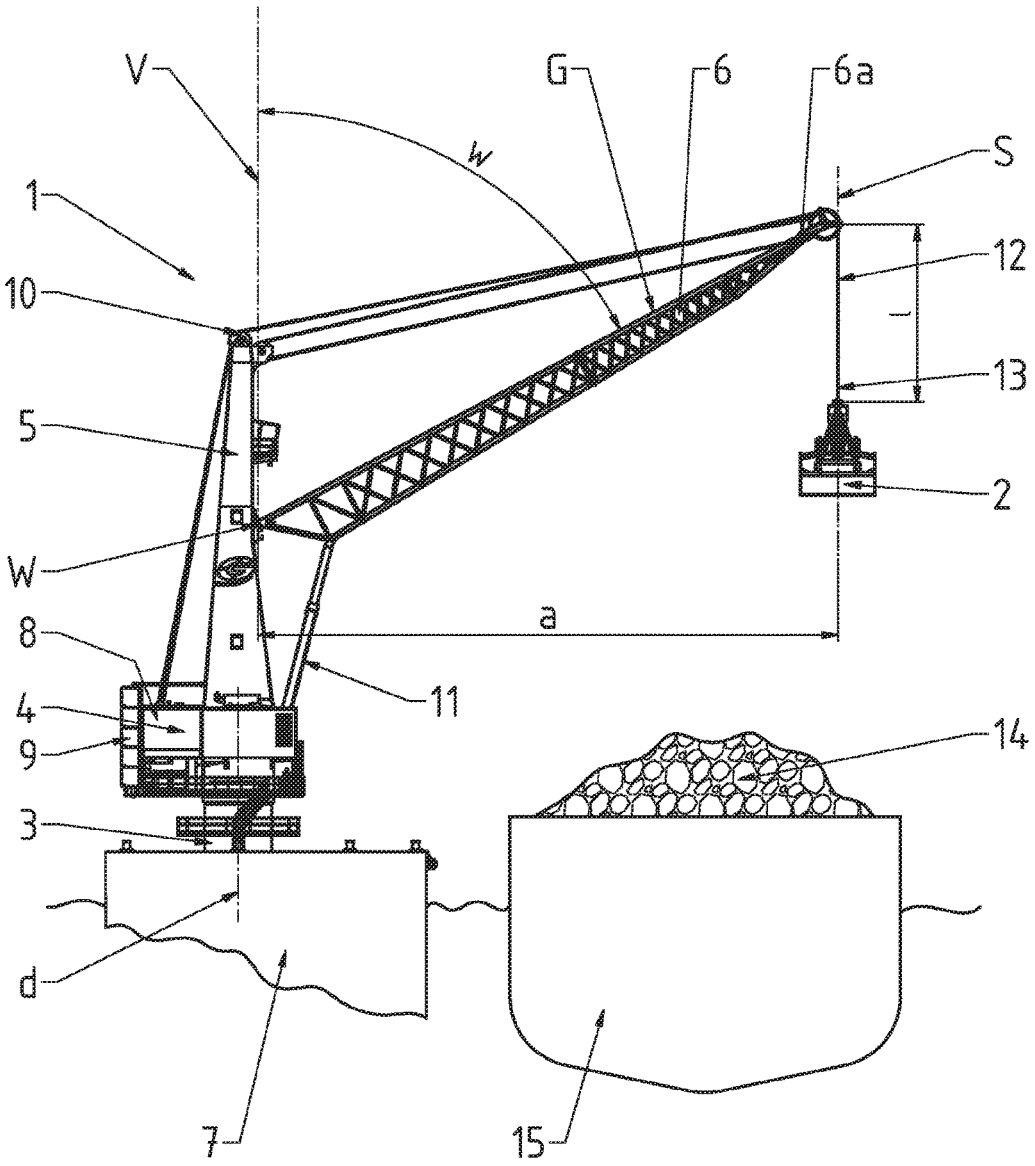
FIG. 1 shows a view of a wharf crane comprising a gripper for bulk material.

FIG. 1 shows a view of a mobile wharf crane 1 for handling bulk materials 14, such as e.g. ore, coal, grain, gravel or sand, between land and water or within cargo-handling terminals. The mobile wharf crane 1 is equipped with a gripper 2 for handling bulk materials and consists substantially of a tubular fixed base 3 and an upper carriage 4 comprising a tower 5 and a jib 6. The fixed base 3 is fixedly mounted on a floating pontoon 7. Instead of the fixed base 3, a lower carriage can also be provided which rests on a quay for the cargo-handling procedure and can move on the quay on rubber tires or on rails. The upper carriage 4 is rotatably mounted on the fixed base 3 and can be pivoted about a vertical axis of rotation d via a rotary mechanism, not shown. The upper carriage 4 also has a lifting gear 8 in a rearward region of the upper carriage 4, in which a counterweight 9 is also located. Also, the tower 5 which extends in the vertical direction is supported on the upper carriage 4, a pulley head 10 comprising pulleys being attached to the apex of said tower. Furthermore, the jib 5 is articulated to the tower 5 approximately in the region of half its length and on the side facing away from the counterweight 9. The jib 5 is connected at one end to the tower 4 so as to be able to pivot about a horizontal pivot axis W. By means of a lift or tilt mechanism 11 which is articulated to the jib 6 and at the bottom to the upper carriage 4 and which is typically designed as a hydraulic cylinder, the jib 6 can be pivoted through a pivot angle w from its large number of laterally projecting operating positions to an upright rest position. Moreover, the jib 6 is typically designed as a lattice mast. Rotatably mounted on the point 6*a* of the jib 6 facing away from the tower 4 are further pulleys, via which holding cables 12 and closing cables 13 are guided, starting from the lifting gear h via the pulley head 10 and the point 6*a* of the jib, to the gripper 2.

The pivot angle w is formed between a vertical line V extending through the pivot axis W and a straight line G extending in the region of an upper boom of the jib 6 and through the pivot axis W. Typically, a change in the pivot angle w is associated with a change in the working radius a of the crane 1 which is related to the maximum working load of the crane 1. The working radius a corresponds to a horizontal distance between the vertical line V through the pivot axis W and a likewise vertical cable direction S. The cable direction S coincides with the free holding and closing cables 12, 13 running down from and oscillating from the point 6*a* of the jib. Moreover, a measurement of the freely hanging portion of the holding and closing cables 12, 13 between the point 6*a* of the jib and the gripper 2 is indicated by the cable length l.

Moreover, it is evident in FIG. 1 that a ship 15, in particular a lighter, a motor barge or a barge, laden with bulk material 14 can be loaded or unloaded by the crane 1.

Figure 2:
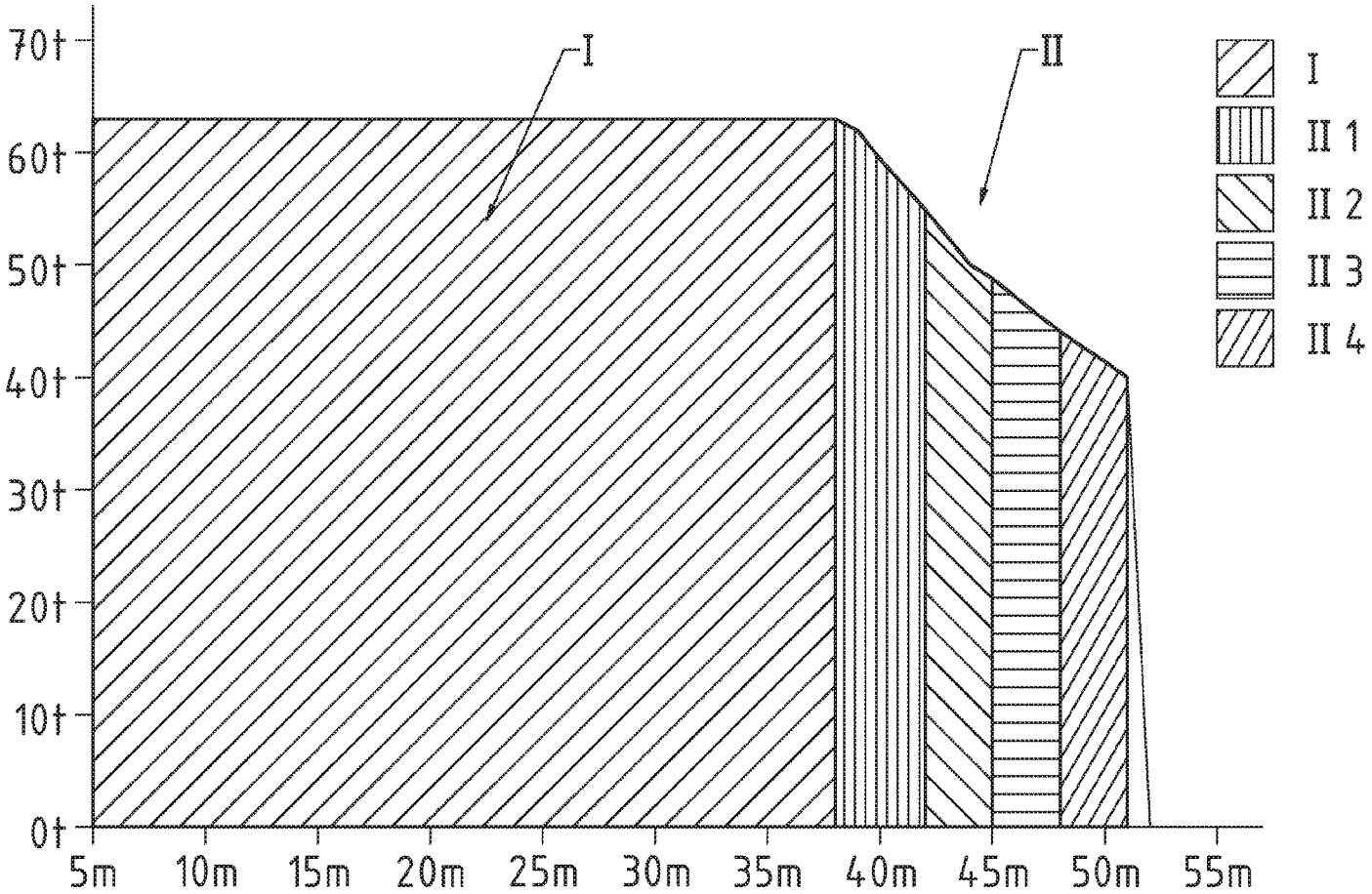
FIG. 2 shows a working load curve of a wharf crane shown in FIG. 1.

FIG. 2 illustrates a so-called working load curve of the wharf crane 1. The working load curve shows the maximum permissible working load of the crane 1 in tons plotted over the working radius a in meters. In this case, approximately two working load ranges I and II can be differentiated. In the first working load range I, a decrease in the maximum permitted working load of approximately 63 t cannot be evidenced on the basis of the dimensioning of the crane 1 in the range of a working radius of 0 m to approximately 38 m. From a working radius a of approximately 38 m to a maximum working radius of approximately 51 m, the maximum permitted working load decreases as the working radius a increases. This range is defined as the second working load range II. In conjunction with the controller in accordance with the invention, the second working load range II has been divided into a first working load subrange II1, second working load subrange II2, third working load subrange II3 and fourth working load subrange II4. On the basis of this working load curve, an overload occurs by definition when the maximum permissible working load is exceeded by approximately 10%.

Figure 3:
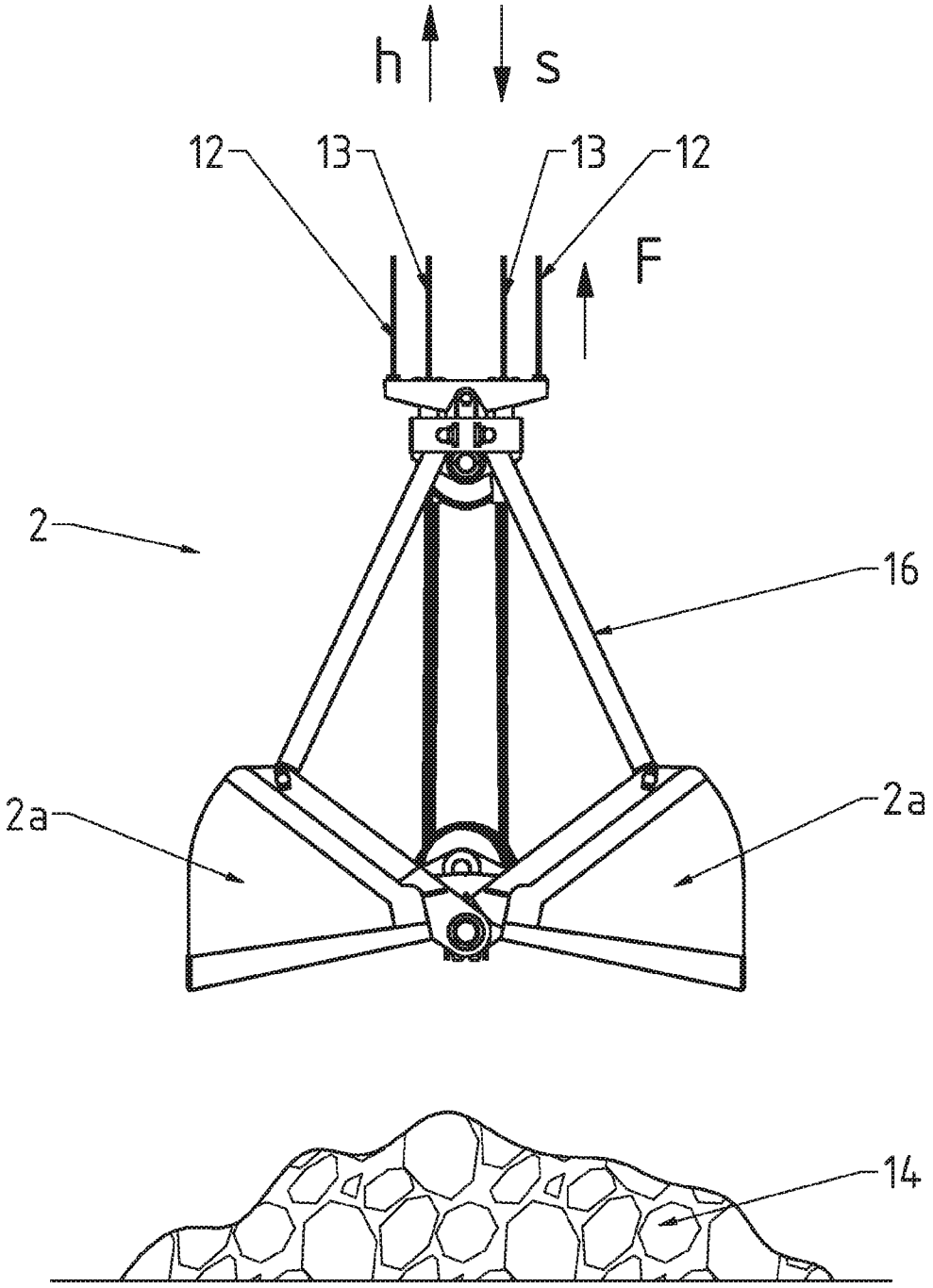
FIG. 3 shows an enlarged view of the gripper for bulk material of FIG. 1.

FIG. 3 illustrates an enlarged view of the gripper 2 for bulk material of FIG. 1. The gripper 2 has two shells 2*a* and is designed as a four-cable gripper which is suspended on two holding cables 12 and two closing cables 13. The holding and closing cables 12, 13 can be rolled up and unrolled independently of one another by two cable drums which are arranged inside the lifting gear 8, are separated from one another and are driven separately by holding and closing winches, in order to open, close, lift and lower the gripper 2. In order to open the gripper 2, the closing cables 13 are untensioned and the gripper 2 is suspended only on the holding cables 12. The holding cables 12 act upon a lever mechanism 16 of the gripper 2 and in conjunction with the weight of the gripper 2 cause the gripper 2 to open. For filling purposes, the opened gripper 2 having a slack closing cable 13 is placed onto the bulk material 14 by means of the holding cables 12. In order to allow the gripper 2 to sink into the bulk material 14 under the effect of its own weight, the holding cable 12 is then slackened. By tightening the closing cables 13 in the direction of lifting h, the gripper 2 is closed. By closing the shells 2*a* of the gripper 2, the gripper is filled with the bulk material 14 and can also dig into the bulk material 14. During digging, a tension force controller 18 for the holding cables 12, which tension force controller also serves as a slack cable controller and is a component of a controller 17 (see FIG. 4), tensions only the holding cables 12, so that the gripper 2 can sink into the bulk material 14 on account of its own weight. The holding cables 12 are tensioned only until the closing cables 13 close the gripper 2. The gripper 2 is also filled with bulk material 14 by means of the closing procedure. After the gripper 2 is closed, it is then raised by the closing cables 13. The holding cables 12 are then tautened in parallel, in order to avoid slack cable. In the region where the gripper 2 is raised, the forces in the holding and closing cables 12, 13 are then adjusted with respect to one another by means of a corresponding controller, so that the subsequent lifting is effected jointly with the holding and closing cables 12, 13.

If too much bulk material 14 is picked up during the gripping procedure, an excessive total load can occur in relation to the maximum permissible working load, taking the current working radius a into account. This total load is made up substantially of the weight of the bulk material 14 picked up, the weight of the gripper 2 and the weight of the free cable length l of the holding and closing cables 12, 13. If an excessive total load is established, further lifting of the load is stopped via a load torque limiter 20 (see FIG. 4), in order to protect the crane. This total load can be determined e.g. in the form of a load force FLast via strain gauges on a cable drum of the lifting gear 8 and is available to the load torque limiter 20 as an input variable. This overload cut-off is recorded in a crane database 21. As described in the introduction, overload cut-offs can occur extensively during crane operation, if the working load of the crane 1, bulk material density, gripper volume and gripper weight are not adapted to one another. This is frequently the case if grippers 2 having an excessive gripper volume are used in relation to the bulk material 14 to be conveyed. However, during operation of the crane 1 the selection of the gripper 2 used is not always optimum.

If during the gripping procedure so much bulk material 14 is picked up by the gripper 2 that the measured total load is less than the maximum permissible working load, a useful load and the total load during opening of the gripper 2 at the target position are recorded in the crane database 21. The useful load in terms of the weight of the bulk material 14 picked up is calculated from the total load minus the weight of the gripper 2 and the weight of the free cable length l of the holding and closing cables 12, 13. A load cycle which has occurred without an overload situation is then also recorded in the crane database 21.

Figure 4:
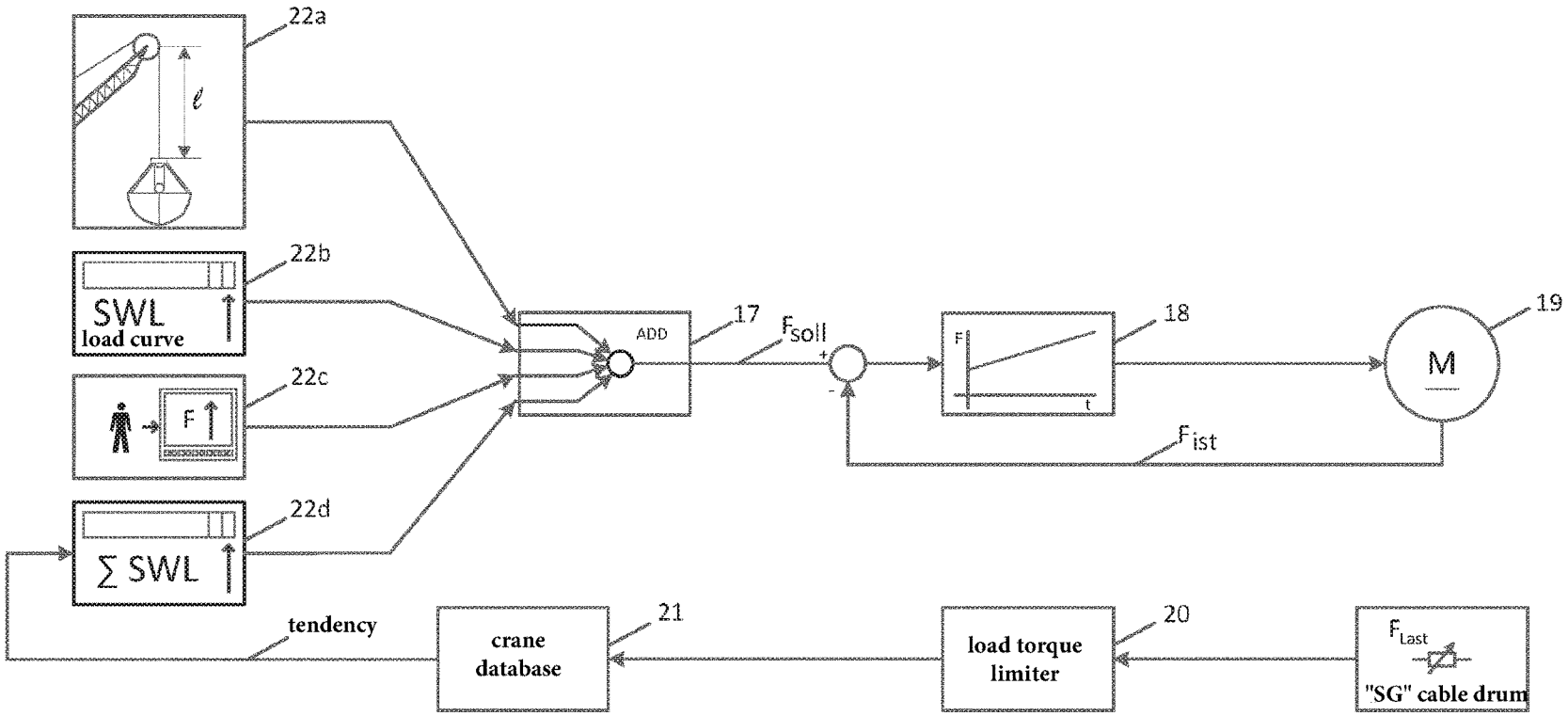
FIG. 4 shows a schematic illustration of a controller for optimizing the fill degree of the gripper for bulk material.

FIG. 4 schematically shows a view of a controller 17, in particular a memory-programmable controller, for optimizing the fill degree of the gripper 2 for bulk material 14, with reference to which the function of the controller 17 will be explained in greater detail. With the aid of the controller 17, the objective of autonomously adapting a fill degree of the gripper 2 filled with bulk material 14 in dependence upon the working load curve of the crane 1 is achieved. In this case, the fill degree of the gripper 2 is optimally utilized without overloading the crane 1 with regard to its working load curve.

The controller 17 outputs as a control variable a tensile force TARGET value Fsoll for the holding cables 12, which value serves as an input variable for the tensile force controller 18. With the aid of this tensile force TARGET value Fsoll, the tensile force controller 18 controls an electric motor 19 which drives a cable drum, not shown, for the holding cables 12. As a further input variable, a tensile force ACTUAL value Fist is supplied to the tensile force controller 18 and corresponds to a measured tensile force in the holding cables 12. The tensile force ACTUAL value first is ascertained from the current data of the electric motor 19, in particular the motor current.

A cable length module 22*a*, a working load curve module 22*b*, a start value module 22*c* and a tendency module 22*d* are allocated as input variables to the controller 17, which is illustrated and operates as an addition module, in addition to a crane database 21. Within the cable length module 22*a*, the cable length l present shortly before the gripper 2 is placed onto the bulk material 14 between the gripper 2 and the point 6*a* of the jib is determined. The weight of the holding and closing cables 12, 13 can then be ascertained thereby. From the working load curve module 22*b*, the controller 17 obtains data relating to the maximum permissible working load (SWL, safe working load) in dependence upon the working radius a. The working radius a is determined typically by the measured pivot angle w. The start value module 22*c* serves as an additional input variable and via which a start variable for the tensile force TARGET value Fsoll can be input manually. This is expedient after a gripper has been replaced, in order to achieve optimum filling of the gripper 2 more rapidly. The tendency module 22*d* is also provided in which tendencies are ascertained from ascertained capacity utilizations related to the maximum permissible working load, said tendencies leading to an increase or decrease in the tensile force TARGET value Fsoll. The tendencies can be adjusted on the basis of empirical values. In particular, the tendency module 22*d* ascertains the number of overload cut-offs which correspond approximately to a more than 110% capacity utilization of the maximum permissible working load.

The controller 17 forms an iterative process in which the fill degree of the gripper 2 is adjusted to the working load curve. Beginning with an overload cut-off by reason of an excessive load in the gripper 2, the working radius a and the working load are stored. When the gripper 2 penetrates again into the bulk material 14, the holding cables 12 thereof are tensioned corresponding to the working radius a with a preselected value, in order to ensure that the gripper 2 penetrates less deeply into the bulk material 14 by reason of its own weight. In this manner, the gripper 2 picks up less material and the crane 1 can be operated depending on the size of the preselected value without an overload cut-off. Since the penetration of the gripper into the material is dependent on different factors, the preselected value is recalculated for each gripping procedure.

During the handling operation, tendencies are formed in the controller 17 with the aid of the data recorded in the crane database 21 and relating to the current handling operation with regard to the number of overload cut-offs and the number of load cycles. If these tendencies reveal a frequency of overload cut-offs which exceeds a preselected value in relation to the load cycles, the tensile force TARGET value Fsoll is increased in the controller 17. These tendencies can be related to the maximum permissible working load being exceeded for the given working radius a, so that an increase in the tensile force TARGET value Fsoll can occur even in the case where the maximum permissible working load is exceeded once or several times within a specified number of load cycles, without overload cut-offs having already occurred. Should this increase not be sufficient because the frequency of overload cut-offs or the exceedances of the maximum permissible working load, which exceeds a preselected value in relation to the load cycles, still occurs, the tensile force TARGET value Fsoll is increased further. As a result, the tensile force TARGET value Fsoll is thus incremented until the frequency of overload cut-offs or exceedances of the maximum permissible working load no longer exceeds the preselected value in relation to the load cycles.

If, during the handling operation, the tendencies formed in the controller 17 reveal a frequency of overload cut-offs or exceedances which does not reach a preselected value in relation to the load cycles, i.e. in other words corresponding shortfalls, the tensile force TARGET value Fsoll is decreased in the controller. Should this decrease not be sufficient because the frequency of overload cut-offs still does not reach a preselected value in relation to the load cycles, the tensile force TARGET value Fsoll is decreased further. As a result, the tensile force TARGET value Fsoll is thus decremented until the frequency of overload cut-offs reaches the preselected value in relation to the load cycles.

How much the tensile force TARGET value Fsoll is increased or decreased in the controller 17 and how quickly there is a reaction to the tendency change can be parameterized in the controller 17. As a consequence, the controller 17 is adapted to the crane 1, the working load curve of the crane 1, the bulk material density, the gripper volume and the gripper weight.

The tensile force TARGET value Fsoll is also increased if the selected working load curve is sufficiently utilized. This prevents the overload limit values from being exceeded. This occurs via corresponding fuzzy logic in the controller 17. This increase in the tensile force TARGET value Fsoll additionally serves to pretension the holding cables 12 sufficiently at the end of the closing procedure of the gripper 2, so that when the gripper 2 is virtually closed the load is divided onto all four cables 12, 13 and therefore no "dead time" occurs when the gripper 2 is being raised.

Moreover, the tensile force TARGET values Fsoll are automatically adapted in order to take into account the free cable length l of the holding and closing cables 12, 13. The tensile force TARGET values Fsoll are increased proportionally in dependence upon the cable length l as the cable length l increases and are decreased proportionally in dependence upon the cable length l as the cable length l decreases. This proportional adaptation of the tensile force TARGET values Fsoll results in the tensile forces being equalized which occurs by reason of the weight of the holding and closing cables 12, 13.

The tensile force TARGET values Fsoll are further automatically adapted when the working radius changes and thus when the maximum permissible working load changes.

It is also possible for the crane driver to manually input a tensile force TARGET value Fsoll into the controller 17 which is then stored and used as a start value for the controller 17. This manual value assists the crane driver if heavy loads are to be handled, in that the tensile force TARGET value Fsoll is pre-controlled in advance to a value, without the overload tendency or exceedance tendency being determined beforehand.

In relation to the evaluation of the tendencies in the controller 17 which results in the tensile force TARGET value Fsoll being calculated, provision is made that this value is calculated taking into account the working load curve with the first working load range I, the first working load sub-range II1, the second working load sub-range II2, the third working load sub-range II3 and the fourth working load sub-range II4. In the first working load range I, the maximum permissible load is not dependent upon the working radius. Therefore, a correction is not made to the tensile force TARGET value Fsoll. The non-linear second working load range II is divided into the working load sub-ranges II1, II2, II3 and II4. In the controller 17, the ascertained tendencies are allocated to the different working load ranges or sub-ranges I, II1, II2, II3 and II4. Therefore, optimum filling of the gripper 2 can be achieved more rapidly in dependence upon the working radius. This is useful if e.g. the crane 1 is alternating between different hatchways of a ship 15. Therefore, the crane 1 always operates even during the first load cycle with the maximum permissible load without any undesired overload cut-offs.

In the controller 17, the individual increases or decreases in the tensile force TARGET value Fsoll are added together and are transmitted to the tensile force controller 18.

In order to adapt the controller 17 to the crane 1, the working load curve of the crane 1, the bulk material density, the gripper volume and the gripper weight, the controller 17 can be parameterized with the following values:

- number of load cycles until the tension target value is increased (default=1.0), example: if 1.0 is specified, the target value is increased if an overload cut-off occurs.
- value of the percentage increase in the tension target value (default=5.0)
- number of load cycles until the tension target value is reduced (default=2.0), example: if 2.0 is specified, the tension target value is reduced if a second load cycle is performed with a fill degree of less than 80%.
- value of the percentage reduction in the tension target value (default=3.0).

These values are input within the scope of an initial operation of the crane 1 with different grippers 2. Also, within the scope of the initial operation of the crane 1 a basic tensile force TARGET value is ascertained in each case for different grippers 2 or at least for the lightest gripper 2, said value being input manually as an initial value into the controller 17 when a gripper is replaced. During the initial operation, the parameters are optimized in order to rapidly achieve an optimum filling behavior of the gripper 2. If e.g. very large and very heavy grippers are used, the tensile force TARGET value Fsoll as a percentage of the nominal torque of the electric motor 19 is adjusted such that the gripper 2 no longer sinks at all into the bulk material 14. The electric motor 19 then applies such a high torque that the gripper weight is held.

After the initial operation, a check is made to establish whether the adjustments are successful in practice and suitable where appropriate.

In the event that overload cut-offs occur, after approximately 3 consecutive cut-offs the frequency of the cut-off can be reduced by changing the parameters or by manually specifying the tensile force TARGET value Fsoll. Within the controller 17, the parameters which influence the change in the tensile force TARGET value Fsoll can be adjusted. An adjustment is made within the scope of the initial operation of the crane in dependence upon the crane and the gripper used. Since the objective of the controller 17 in accordance with the invention is to optimally fill the gripper 2 with bulk material 14, each optimized handling procedure will take place at approximately 100% of the permissible working load, i.e. close to an overload, so that by means of the incremental increase and decrease in the tensile force TARGET value Fsoll overload cut-offs still occur but do so at a significantly reduced frequency. Within the scope of the handling operation, 10% overload cut-offs in relation to the load cycles per hour are not considered to be disruptive and are considered within the scope of the present controller 17 to be a good result for the controller. This means, at e.g. 50 to 60 load cycles per hour, that 5 to 6 overload cut-offs can continue to occur. In this case, an overload cut-off is also counted as a load cycle. Without the controller 17 in accordance with the invention, overload cut-offs of up to 50% of the load cycles per hour can occur, in particular if the crane is used in relation to a heavy bulk material 14 with a gripper 2 which is too large in relation to the bulk material density.

Each overload cut-off causes a longer cycle time during operation which has a negative impact upon the handling performance. By means of the controller 17 in accordance with the invention, the gripper 2 always becomes completely full over time, even if work is taking place at different hatchways, because the gripper is always used to capacity automatically in dependence upon the working radius a and this occurs without the intervention of the crane driver.

Since the tensile forces acting in the holding cables 12 are proportional to a torque which is applied to the cable drum for the holding cables 12 and is applied by the electric motor 19, the invention described above includes not only a determination and control of tensile forces but also of corresponding torques.

The invention claimed is:

1. A method for filling a gripper with bulk material, the gripper being suspended on holding cables, raised and lowered by a crane via a tension force controller, and acting on the bulk material with its own weight during a closing and filling procedure, wherein by reducing the effect of the weight of the gripper on the bulk material, a fill degree of the gripper is influenced by adjusting a tensile force acting on the holding cables, the method comprising:

determining in a crane controller a tensile force target value for the holding cables;

supplying the tensile force target value as a first input variable to the tension force controller;

controlling an electric motor via the tensile force controller using the tensile force target value for lifting and lowering the gripper via the holding cables;

ascertaining a tensile force actual value of the holding cables while the gripper is lifted or lowered during said controlling the electric motor via the tensile force controller;

supplying the tensile force actual value as a second input variable to the tensile force controller for controlling the electric motor to adjust the fill degree of the gripper for a subsequent gripping procedure based on differences between the tensile force target value and the tensile force actual value;

determining in the crane controller (i) when a change in the tensile force target value is to be made and (ii) an amount of change of the tensile force target value, based on determining working loads of the crane for a plurality of gripping procedures after the gripper is filled and raised and determining the number of overload cut-offs and/or the number of working loads exceeding a maximum permissible working load for the plurality of gripping procedures to dynamically adjust the tensile force target value, and supplying the amount of change of the tensile force target value to the tension force controller.

2. The method as claimed in claim 1, wherein a frequency of overload cut-offs and a frequency at which the maximum permissible working load is exceeded are monitored in the crane controller, and wherein the tensile force target value is increased in response to (1) the frequency of overload cut-offs exceeding a preselected value related to the load cycles or (2) the frequency at which the maximum permissible working load is exceeded being greater than a value preselected in relation to the maximum permissible working load for a given working radius.

3. The method as claimed in claim 2, wherein a frequency of overload cut-offs and a frequency at which the maximum permissible working load is exceeded are monitored in the crane controller, and wherein the tensile force target value is decreased in response to (1) the frequency of overload cut-offs being less than a preselected value related to the load cycles or (2) the frequency at which the maximum permissible working load is exceeded being less than a value preselected in relation to the maximum permissible working load for a given working radius.

4. The method as claimed in claim 3, further comprising:

adjusting the gripper with the tensile force actual value, which is directed in a direction of lifting, during the closing and filling procedure.

5. The method as claimed in claim 4, further comprising:

ascertaining a working load after the filled gripper is raised; and determining the fill degree of the gripper from the determined working load and a known weight of the gripper when empty.

6. The method as claimed in claim 5, further comprising:

supplying a measurement of length of a freely hanging portion of the holding cable starting from the gripper and in the direction of lifting as an input variable to the crane controller; and adding a weight of the freely hanging portion of the holding cable to the weight of the gripper during said determining the fill degree of the gripper.

7. The method as claimed in claim 2, further comprising:

ascertaining a working load after the filled gripper is raised; and determining the fill degree of the gripper from the determined working load and a known weight of the gripper when empty.

8. The method as claimed in claim 1, wherein a frequency of overload cut-offs and a frequency at which the maximum permissible working load is exceeded are monitored in the crane controller, and wherein the tensile force target value is decreased in response to (1) the frequency of overload cut-offs being less than a preselected value related to the load cycles or (2) the frequency at which the maximum permissible working load is exceeded being less than a value preselected in relation to the maximum permissible working load for a given working radius.

9. The method as claimed in claim 1, further comprising:

adjusting the gripper with the tensile force actual value, which is directed in a direction of lifting, during the closing and filling procedure.

10. The method as claimed in claim 1, further comprising:

determining the fill degree of the gripper from the determined working load and a known weight of the gripper when empty for each of the plurality of gripping procedures in order to determine the amount of change of the tensile force target value for the holding cables, wherein said determining working loads of the crane for the plurality of gripping procedures comprises sensing the weight of the bulk material lifted during the plurality of gripping procedures.

11. The method as claimed in claim 10, further comprising:

supplying a measurement of length of a freely hanging portion of the holding cable starting from the gripper and in the direction of lifting as an input variable to the crane controller; and adding a weight of the freely hanging portion of the holding cable to the weight of the gripper during said determining the fill degree of the gripper.

12. The method as claimed in claim 11, further comprising:

supplying a maximum permissible working load as an input variable to the crane controller, the maximum permissible working load being dependent upon a working radius of the gripper.

13. The method as claimed in claim 12, further comprising:

iteratively decreasing or increasing the tensile force target value to drive the determined fill degree toward 100 percent.

14. The method as claimed in claim 13, further comprising receiving a manually input tensile force target value in the crane controller as a start variable for the first input variable prior to said determining in the crane controller the tensile force target value.

15. The method as claimed in claim 10, further comprising:

iteratively decreasing or increasing the tensile force target value to drive the determined fill degree toward 100 percent.

16. The method as claimed in claim 1, wherein said crane controller comprises said tensile force controller.

17. The method as claimed in claim 1, further comprising:

adjusting the gripper with the tensile force actual value, which is directed in a direction of lifting, during the closing and filling procedure.

18. The method as claimed in claim 1, further comprising: supplying a maximum permissible working load as an input variable to the crane controller, the maximum permissible working load being dependent upon a working radius of the gripper.

19. The method as claimed in claim 1, further comprising receiving a manually input tensile force target value in the crane controller as a start variable for the first input variable prior to said determining in the crane controller the tensile force target value.

* * * * *